United States Patent [19]

Zollinger et al.

[11] 3,958,609

[45] May 25, 1976

[54] DEVICES FOR INSERTION OF FILLING YARN IN A LOOM BY MEANS OF A FLUID

[75] Inventors: Hans Zollinger, Tann-Ruti; Rolf Honegger, Durnten, both of Switzerland

[73] Assignee: Maschinenfabrik Ruti AG, Ruti (Zurich), Switzerland

[22] Filed: June 20, 1974

[21] Appl. No.: 481,252

[30] Foreign Application Priority Data

June 25, 1973 Switzerland ..... 9231/73

[52] U.S. Cl. ..... 139/435

[51] Int. Cl.[2] ..... D03D 47/28

[58] Field of Search ..... 139/122 R, 123, 127 R, 139/127 P, 188, 190, 191, 192

[56] References Cited

UNITED STATES PATENTS

| | | | |
|---|---|---|---|
| 3,139,118 | 6/1964 | Svaty et al. | 139/127 |
| 3,818,952 | 6/1974 | Vermeulen et al. | 139/127 |

*Primary Examiner*—Henry S. Jaudon
*Attorney, Agent, or Firm*—Donald D. Denton

[57] ABSTRACT

The present invention relates to devices for use in a loom for fluid insertion of the filling yarn, the loom having a reed, each of whose teeth defines a bulge with the opening of the bulge facing the fell of the cloth being woven to provide for better beat-up, all of said bulges together forming a guide channel for the passage of fluid which serves for the insertion of the filling yarn.

8 Claims, 4 Drawing Figures

37
12
α
34
20
30
21
24
33
31
28
25
36
23
22
35
37
26
27
32
11
32A
13

34
γ
β
38
30
40
39
20

DEVICES FOR INSERTION OF FILLING YARN IN A LOOM BY MEANS OF A FLUID

BACKGROUND

In known looms of this type, the bulges in the teeth of the reed which form the guide channel for the fluid are so developed and the reed is so controlled in its forward and backward movement that the filling thread inserted remains in the guide channel during the beating-up and emerges from the guide channel only upon the subsequent rearward movement of the lay. The beating-up of the filling threads therefore is effected by the portions of the teeth of the reed which form the lowest point in the bulges.

With this known development, difficulties result with regard to the shaping and arrangement of the stretchers necessary to obtain a proper fabric. If the stretchers are of conventional development, they cannot be arranged at a sufficiently small distance in front of the place where the filling thread is beaten-up, since on the one hand the teeth of the reed have portions which extend forward beyond the place of beating-up in the beating-up position, said portions having the flanks of the bulges which form the guide channel, while on the other hand there is no room for the stretchers in the cross-section of the guide channel. However, an insufficiently small distance between the beating-up point and the stretchers results in the disadvantage that upon the beating-up of the filling yarn, the fabric shrinks somewhat in its width and as a result the warp yarns are no longer parallel in the regions of the edges of the shed, which may impede the movement of the reed and lead to a scraping of the teeth of the reed against the warp yarns. In order to exclude this disadvantage, it has been attempted to adapt the development of the stretchers and of the bulges of the reed teeth which form the guide channel to each other in such a manner that the stretchers enter the guide channel upon the beating-up movement of the reed. This, however, requires a special flat construction of the stretchers which is of little strength and is less protective of the cloth than the traditional stretchers for which there is no room in the cross-section of the guide channel.

Looms are also known in which the devices for the insertion of the filling yarns by means of a fluid have a comb of parallel confusor blades, each having a bulge to form the guide channel for the fluid serving for the insertion of the filling yarn, the confusor blades being separated from the reed teeth but being firmly connected with the lay in such a manner that they emerge completely from the shed during the beating-up movement of the lay so as to enable the reed to beat-up the filling yarn which has been previously inserted and upon the subsequent rearward movement of the lay again to move between warp yarns in order upon the next insertion of the filling yarn to provide the desired guidance within the shed of the fluid which inserts the warp yarn. With this development of the machine, the reed can be provided in conventional manner with linearly extending reed teeth and it is possible to mount the stretchers of ordinary construction sufficiently close to the fell of the cloth so that no problems occur in this respect. On the other hand, with this development of the loom, the insertion of the confusor blades between war yarns after the beating-up of each filling yarn is not without difficulties since at times a warp yarn may be caught on a confusor blade which leads to weaving defects and may cause the breaking of warp yarns.

SUMMARY

The present invention relates to devices for a loom of the aforementioned type capable of functioning in such a way, in a relatively simple manner, in order to avoid the above-described disadvantages of known embodiments that either require confusor blades which move in and out between warp yarns or special stretchers in order to be able to maintain the desirably small distance between the fell of the cloth and the stretchers. Therefore, the devices of the present invention will accommodate stretchers of conventional construction since they can be mounted directly in front of the fell of the cloth.

The objects of this invention are achieved essentially in a loom of the aforementioned type in the manner that an at least approximately linear portion of the tooth smoothly joins the bulge of each reed tooth and the forward and backward movement of the reed is conducted in such a manner that the bulges of the reed teeth lie within the shed when the reed is in the position in which the insertion of the filling yarn takes place and the linear portion of the reed tooth is located at the place of beating-up when the reed is in the filling-yarn beating-up position.

With this development the result is obtained that the filling yarn which is introduced into the guide channel by means of a fluid insertion, for instance compressed air, during the beating-up movement of the lay comes out of the bulges of the reed teeth and comes to lie in front of the linearly extending portions of the reed teeth and that the beating-up of the filling yarn against the cloth which has already been woven is effected by means of the linear portions of the reed teeth. The stretchers can therefore be arranged without difficulty at a sufficiently small distance from the place where the warp yarn is beaten-up even if they are of conventional development since upon the beating-up of the filling yarn the stretchers do not have to enter into the guide channel formed by the bulges in the reed teeth. Nevertheless there are no confusor blades to be moved in and out between warp yarns and which could give rise to weaving defects and the breaking of warp yarns. In one suitable embodiment the linearly extending portion and the adjoining flank of the bulge of each reed tooth are at an angle of between 135° and 180° and preferably 150° to 180° to each other while the other flank of the bulge and the linearly extending portion of each reed tooth are advantageously at an angle of about 90° apart.

The reed is preferably moved back and forth in known manner by means of swingably supported lay swords. In a preferred embodiment of the invention, the path of movement of the bulge of each reed tooth may extend along a circular arc which obliquely intersects the group of warp yarns facing the axis of swing of the lay swords when the shed is open and the linearly extending portion of the reed teeth, when the reed is in the beating-up position, extends at least approximately at right angles to the middle warp-yarn direction and is inclined with respect to a line radial to the axis of swing of the lay swords which passes through the vertex of the bulge.

BRIEF DESCRIPTION OF THE DRAWINGS

Further details of the invention will become evident from the following description of specific embodiments and from the corresponding drawings which show the subject matter of the invention diagrammatically and by way of example, and which merely illustrate the subject matter of the invention, in which.

DESCRIPTION OF PREFERRED EMBODIMENTS

Figures 1, 2:
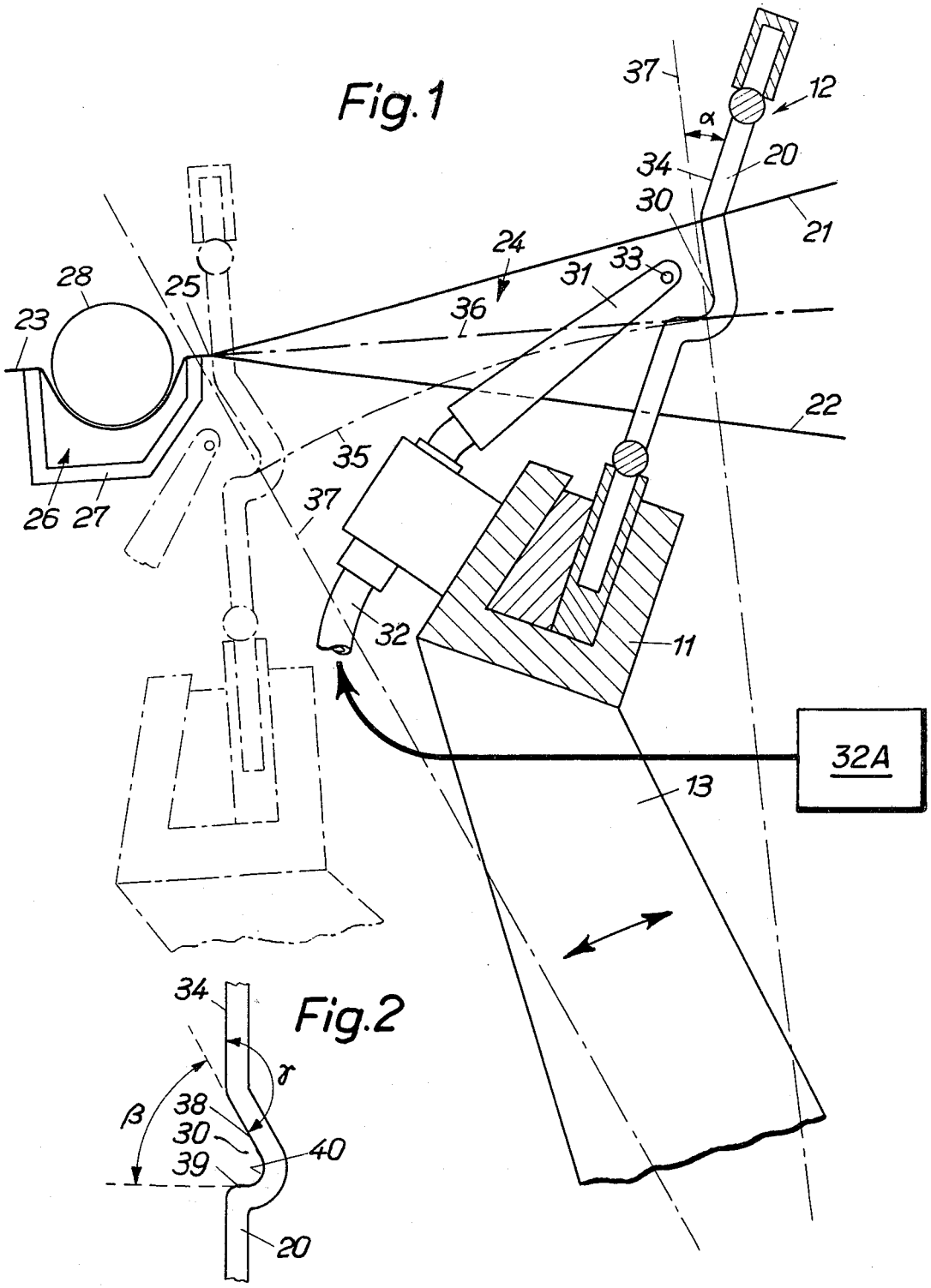
FIG. 1 shows in vertical view along the warp yarns a portion of a loom having the device of this invention, the device shown in solid lines in its position upon the insertion of the filling yarn, and in dot-dash lines in its position at the beating-up point of the filling yarn.
FIG. 2 shows a partial vertical view of an individual reed tooth of the part of the loom shown in FIG. 1.

The loom shown in FIG. 1 has a lay 11 which bears a reed 12. The lay 11 is supported by lay swords 13 which are swingable around an axis lying outside the plane of the drawing. In known manner the lay swords 13 are so driven by cranks or eccentrics (not shown) of the main shaft of the loom via connecting rods that upon rotation of the main shaft a backward and forward swinging movement of the lay swords 13 and of the lay 11 takes place.

The reed 12 has blade shaped reed teeth 20 only one of which is visible in FIG. 1 since the reed teeth cover one another. Between the reed teeth there pass in customary fashion warp yarns 21 and 22 which, together with the filling yarns (not shown) form the cloth 23 which is to be produced. The shed 24 necessary for the insertion of the weft yarns between an upper group of warp yarns 21 and a lower group of warp yarns 22 is formed in known manner (not shown) by means of shafts. The beating-up of the previously inserted filling yarn against the cloth 23 which has already been produced is effected at the beating-up point (fell) 25 by means of the teeth 20 of the reed 12, as is generally known. At a slight distance from the beating-up point 25 there are located stretchers 26 of customary development each of which, by means of a fixed part 27 and a rotating part 28, grasps the selvage or edge portions of the cloth 23 produced and continuously pulls same outward so as to stretch the cloth in width so that the warp yarns 21 and 22 of the upper and lower groups of warp yarns always extend parallel towards the beating-up point 25.

Each reed tooth 20 is provided on the front side thereof facing the fell 25 with an inwardly directed bulge 30 which has its opening facing the fell 25. The bulges 30 of all the reed teeth 20 coincide with each other and together form a guide channel for a fluid serving for the insertion of the filling yarn, for instance compressed air. The said fluid is fed by means of a main nozzle located on one side of the shed and a plurality of auxiliary nozzles 31 from hoses 32 from a fluid source means 32A. The auxiliary nozzles 31 are distributed at suitable distances apart along the lay 11 and fastened to the lay. The outlet openings 33 of the nozzles 31 are so arranged and directed that a stream of fluid is produced in the guide channel formed by the bulges 30 transversely through the shed 24 when the nozzles are placed in operation. Immediately above the bulge 30, each reed tooth 20 has a linearly extending portion 34 which smoothly or directly joins the bulge 30. The said linearly extending portion 34 of the reed teeth serves for beating-up the previously introduced filling yarn against the cloth 23 which has already been produced.

The axis of swing of the lay swords 13 has a position which is so set back with respect to the beating-up point 25 that upon the forward and backward movement of the lay 11 the bulge 30 of each reed tooth 20 moves along an arcuate path 35 which obliquely intersects the lower group of warp yarns 22 in the open position of the shed. The guide channel for the fluid serving for the insertion of the filling yarn which is formed by the inwardly directed bulges 30 is located within the shed 24 when the lay 11 is moved towards the rear (towards the right in FIG. 1) into the filling yarn insertion position and is outside the shed when the lay 11 is moved into the filling yarn beating-up position (dot-dash lines in FIG. 1). In said last mentioned position of the lay 11, the linearly extending portion 34 of each reed tooth 20 is located at the beating-up point 25.

In order that the filling yarns can be properly beaten-up by the linearly extending portion 34 of each reed tooth 20, the reed 12 is so arranged that in the beating-up position of the reed the said linearly extending portion is approximately perpendicular to the middle direction 36 of the warp yarn and is thus not radial to the axis of swing of the lay swords 13 but differs by an angle $\alpha$ which lies for instance in the range of 25° to 30° from a radial line 37 to the axis of swing of the lay swords which passes through the vertex of the bulge 30.

As shown in the detailed view of FIG. 2, the bulge 30 of each reed tooth 20 has two approximately linear extending flanks 38 and 39 which are connected to each other by a circular arc 40 forming the vertex portion of the bulge. In the embodiment shown, the two extending flanks 38 and 39 form with each other an angle $\beta$ which is approximately 60°, the linearly extending portion 34 and the adjoining upper flank 38 being at an angle $\gamma$ to each other of about 150° while the lower flank 39 is approximately perpendicular to the linearly extending portion 34. By this development of the bulge 30, the result is obtained that on the one hand the filling yarn introduced by means of the fluid is secured by the lower flank 39 from dropping down while on the other hand upon the beating-up movement of the lay 11 the filling yarn slides along the upper flank 38 out of the bulge 30 to in front of the linearly extending portion 34 of each reed tooth 20 on a ridgeless smooth surface while the bulge 30 moves out of the shed 24 along its arcuate path of movement 35 (see FIGS. 1 and 3).

The manner of operation of the devices for the insertion and beating-up of the filling yarns which have been described is as follows:

When the lay 11 moves into its upper dead center position, i.e. into its greatest possible distance from the filling yarn beating-up point 25, the reed 12 and the nozzles 31 assume the solid line positions shown in FIG. 1. While the bulge 30 of each reed tooth 20 is within the open shed 24 and the nozzles 31 extend between warp yarns 22 of the lower group of warp yarns also into the shed 24, a filling yarn is introduced by the fluid flowing out of the main nozzle and the fluid from the auxiliary nozzles into the guide channel formed by the bulges 30 of the reed teeth 12. Upon the subsequent forward movement of the lay 11 towards the beating-up point 25, the bulges 30 of the reed teeth 12 move along the arcuate path of movement 35 obliquely downward out of the shed 24. In this connection the previously inserted filling yarn is moved by the reed 12 against the beating-up point 25 but it is prevented by the lower group of warp yarns 22 from following along in the downward movement of the bulges 30 of the reed teeth. Therefore, the filling yarn slides along the upper flank 38 of the bulges 30 upward until it emerges completely from the bulges and comes to lie in front of the linearly extending portion 34 of the reed teeth 12. When the lay 11 and the reed 12 assume the position shown in dot-dash outline as in FIG. 1, the filling yarn is beaten-up by the linearly extending portion 34 of the reed teeth 20 against the previously produced cloth 23 at the point 24 which is located in the immediate vicinity of the stretchers 26. Since the nozzles 31 are firmly arranged on the lay 11 and do not move relative to the reed 12, the nozzles move downward out of the shed upon the said beating-up movement of the lay 11 before the reed comes into the vicinity of the beating-up point 25. The beating-up of the filling yarn is therefore in no way impeded by the nozzles 31.

After the filling yarn has been beaten-up against the cloth 23, the lay 11, together with the reed 12 and the nozzles 31, moves back in opposite direction into the position which permits the introduction of the filling yarn, whereupon the processes described are repeated.

It will be appreciated that the values indicated in the above-described embodiment for the angles $\alpha$, $\beta$, and $\gamma$ can vary within limits. Thus, for instance, the angle $\beta$ can be reduced to 45°, in which case the angle $\alpha$ assumes a value of 135°. Values of less than 45° for the angle $\beta$ and 135° for the angle $\gamma$ are inadvisable, since in such case the sliding of the filling yarn out of the bulges 30 along the upper flank 38 is made difficult or even impossible. Conversely, it may be advantageous to increase the angle $\beta$ to for instance about 75°, in which case the angle $\gamma$ assumes a value of about 165°. In the extreme case, the angle $\beta$ may even amount to about 90° and the angle $\gamma$ to 180°, as shown in the embodiment of FIGS. 3 and 4.

The second embodiment, shown in FIGS. 3 and 4, will be described below only with reference to its differences from the first embodiment. The same reference numbers as in FIGS. 1 and 2 have been used for identical parts. The main difference resides in the shape of the reed teeth. In the embodiment of FIGS. 3 and 4 reed 112 has bladelike reed teeth 120, each of which is provided with a bulge 130 on the front side thereof facing the beating-up point 25. This bulge 130 has two linearly developed flanks 138 and 139 which are connected to each other by an arcuate vertex portion 140. The two flanks 138 and 139 form an angle $\beta'$ with each other which is substantially about 90°. The one flank 138 passes smoothly and without change of direction into a linearly extending portion 134 which serves to beat the inserted filling yarn against the cloth 23 which has already been formed. The other flank 138 is approximately perpendicular to the said linearly extending portion 134.

Figures 3, 4:
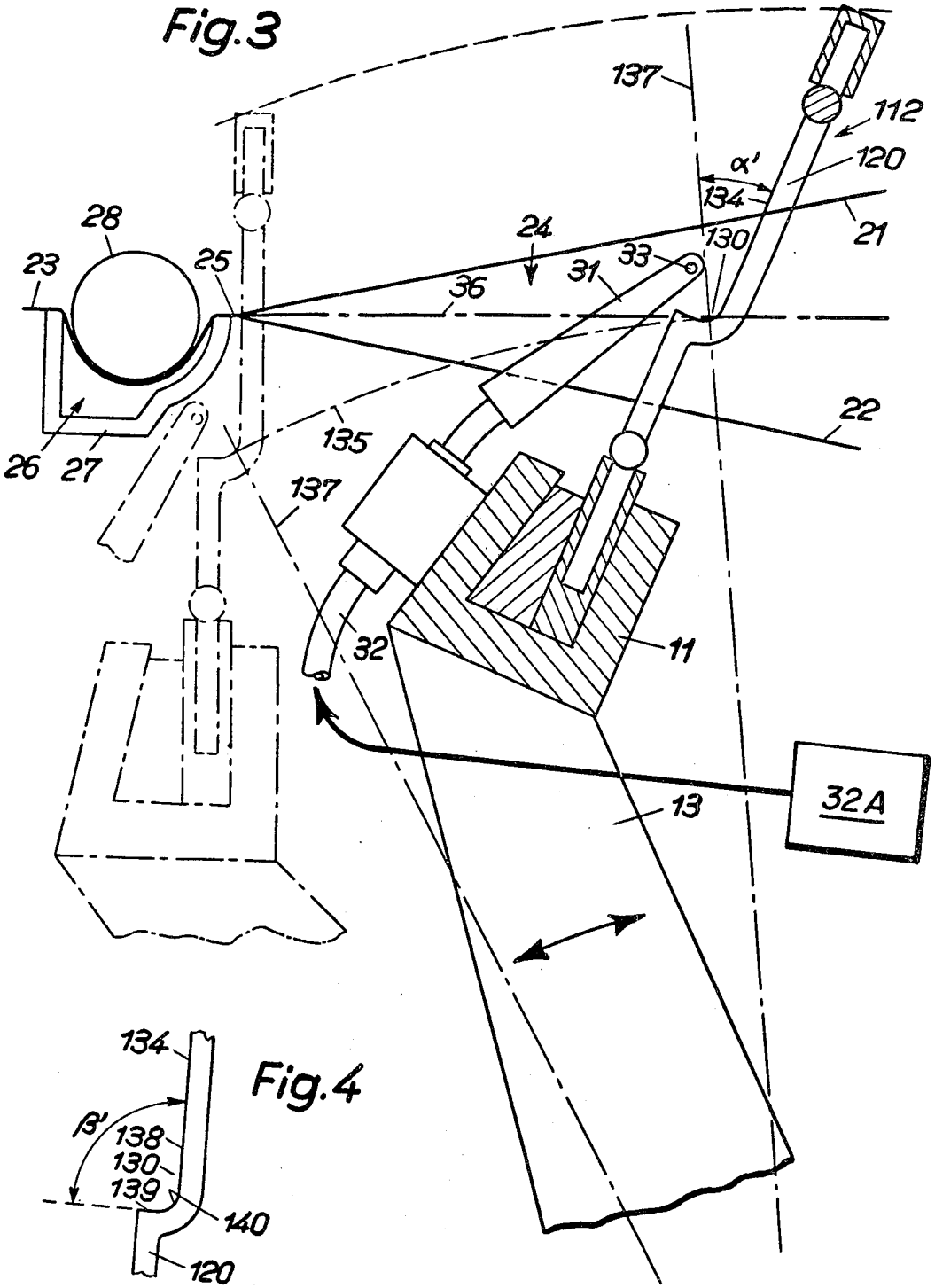
FIG. 3 shows a second embodiment of reed tooth similar to the part of the loom illustrated in FIG. 1.
FIG. 4 shows a partial vertical view of an individual reed tooth of the part of the loom shown in FIG. 3.

The axis of swing (located outside the sheet of the drawing) of the lay swords 13 is so far towards the rear with respect to the beating-up point 25, i.e. to the right in FIG. 3, that upon the backward and forward movements of the lay 11, the bulge 130 of each reed tooth 120 passes over an arcuate path of movement 135 which obliquely intersects the lower warp yarns 22 when the shed is open. The reed 120 is so arranged that in the beating-up position, shown in dot-dash line, the linearly extending portion 134 of each reed tooth is approximately perpendicular to the middle warp-yarn direction 36. This means that the said linearly extending portion 134 is not radial to the axis of swing of the lay swords 13 but is inclined with respect to a line 137 radial to the axis of swing rearward by an angle $\alpha'$ which is equal, for instance, to about 30°.

The manner of operation of the reed 112 and of the devices for the insertion of the filling yarns by means of a fluid is in principle the same as in the case of the first embodiment and therefore no description thereof is deemed necessary.

The second embodiment has advantages over the first embodiment since during the beating-up movement of the reed 112 the previously inserted filling yarn slides more easily out of the guide channel formed by the bulges 130 upwards to and in front of the linearly extending portions 134 of the reed teeth which serve for the beating-up of the filling yarn. On the other hand, however, there is the advantage in the case of the first embodiment that the jet of fluid emerging from the nozzles 31 is better held together in the guide channel, since the angle $\beta$ is less than the angle $\beta'$ forming the guide channel.

It is clear that in each of the embodiments of the invention described, the filling yarn beating-up point 25 lies at a very small distance from the stretchers 26 although these stretchers are of conventional construction and although no confusor blades, which are separate from the reed teeth and would have to be periodically moved out of the warp yarns and then introduced again between them, are necessary for the forming of the guide channel for the fluid serving for the insertion of the filling yarn.

It will be appreciated that various changes and modifications may be made within the skill of the art without departing from the spirit and scope of the invention illustrated and described herein.

What is claimed is:

1. A loom having a device for the inserting of filling yarns by means of a fluid and having a reed for beating-up of the filling yarns, each of the teeth of the reed having a bulge the opening of which faces the filling yarn beating-up point, said bulges together forming a guide channel for the fluid serving for the insertion of the filling yarn, in which the bulge of each reed tooth is adjoined smoothly by at least one approximately linearly extending portion of the tooth to present a ridgeless smooth surface on the reed tooth, and the reed is so guided in its backward and forward movements that the bulges of the reed teeth lie within the shed in the position of the reed in which the insertion of the filling yarn takes place, and the linearly extending portion of each reed tooth is at the beating-up point when the reed is in the filling-yarn beating-up position, said bulge moving along an arcuate path and out of the shed so that a weft thread insertion can ride smoothly out of the bulge of each reed tooth on the said ridgeless smooth surface to its beat-up position on said approximately linearly extending portion.

2. Loom according to claim 1 in which the bulge is limited by extending flanks which form with each other an angle within the range of from about 45° to about 90°.

3. Loom according to claim 2 in which the linearly extending portion and the flank, further from it, of the bulge of each reed tooth are approximately perpendicular to each other.

4. Loom according to claim 2 in which the bulges in the reed teeth have their linear extending portions vertical and their lower extending flanks perpendicular at the beat-up point with the bulges below the middle warp-yarn direction line of the shed.

5. Loom according to claim 1 in which the reed is guided back and forth by means of swingably supported lay swords, characterized by the fact that the path of movement of the bulge of each reed tooth follows along a circular arc which, in the open position of the shed, obliquely intersects a group of warp yarns facing the axis of swing of the lay swords, and that in the beating-up position of the reed, the linearly extending portion of the reed teeth extends at least approximately perpendicular to the middle warp-yarn direction and is inclined with respect to a radial line of the axis of swing of the lay swords which passes through the vertex portion of the bulge.

6. Loom according to claim 5 in which in the position of the reed in which the insertion of the filling yarn takes place, the vertex portion of the bulges of the reed teeth is at least approximately in the center of the shed.

7. A loom having a device for the inserting of filling yarns by means of a fluid and having a reed for beating-up of the filling yarns, each of the teeth of the reed having a bulge the opening of which faces the filling yarn beating-up point, said bulges together forming a guide channel for the fluid serving for the insertion of the filling yarn, in which the bulge of each reed tooth is adjoined smoothly by at least one approximately linearly extending portion of the tooth, said linearly extending portion and its adjoining flank of the bulge of each reed tooth positioned at an angle to each other within the range of from about 135° to about 180°, and the reed is so guided in its backward and forward movements that the bulges of the reed teeth lie within the shed in the position of the reed in which the insertion of the filling yarn takes place, and the linearly extending portion of each reed tooth is at the beating-up point when the reed is in the filling-yarn beating-up position.

8. A loom having a device for the inserting of filling yarns by means of a fluid and having a reed for beating-up of the filling yarns, each of the teeth of the reed having a bulge the opening of which faces the filling yarn beating-up point, said bulges together forming a guide channel for the fluid serving for the insertion of the filling yarn, in which the bulge of each reed tooth is adjoined smoothly by at least one approximately linearly extending portion of the tooth, said linearly extending portion and its adjoining flank of the bulge of each reed tooth positioned at an angle in relation to each other within the range of from about 150° to about 165°, and the reed is so guided in its backward and forward movements that the bulges of the reed teeth lie within the shed in the position of the reed in which the insertion of the filling yarn takes place, and the linearly extending portion of each reed tooth is at the beating-up point when the reed is in the filling-yarn beating-up position.

* * * * *